US009055366B2

(12) United States Patent
Azmi et al.

(10) Patent No.: US 9,055,366 B2
(45) Date of Patent: Jun. 9, 2015

(54) MULTI-DRIVER EARBUD

(71) Applicant: Apple Inc., Cupertino, CA (US)

(72) Inventors: Yacine Azmi, San Francisco, CA (US); Arun D. Chawan, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/746,900

(22) Filed: Jan. 22, 2013

(65) Prior Publication Data

US 2014/0205131 A1 Jul. 24, 2014

(51) Int. Cl.

| | |
|---|---|
| ***H04R 25/00*** | (2006.01) |
| ***H04R 1/10*** | (2006.01) |
| *H04R 1/06* | (2006.01) |
| *H04R 1/26* | (2006.01) |
| *H04R 11/02* | (2006.01) |

(52) U.S. Cl.

CPC ..... *H04R 1/1066* (2013.01); *H04R 1/06* (2013.01); *H04R 1/1016* (2013.01); *H04R 1/1075* (2013.01); *H04R 1/26* (2013.01); *H04R 11/02* (2013.01); *H04R 25/604* (2013.01)

(58) Field of Classification Search

CPC ..... H04R 1/1016; H04R 1/26; H04R 1/1075; H04R 11/02; H04R 25/48; H04R 5/033; H04R 1/1058; H04R 1/22; H04R 9/063; H04R 1/1041; H04R 1/1066; H04R 2205/022; H04R 11/00; H04R 1/10; H04R 1/225

USPC ..... 181/129; 381/309, 182, 151, 312, 328, 381/380, 418

See application file for complete search history.

(56) References Cited

U.S. PATENT DOCUMENTS

| | | | | |
|---|---|---|---|---|
| 5,960,093 | A | 9/1999 | Miller | |
| 6,654,477 | B1 | 11/2003 | Miller et al. | |
| 7,194,102 | B2 * | 3/2007 | Harvey | 381/328 |
| 7,317,806 | B2 * | 1/2008 | Harvey et al. | 381/328 |
| 8,098,854 | B2 | 1/2012 | van Halteren et al. | |
| 8,116,502 | B2 | 2/2012 | Saggio, Jr. et al. | |

(Continued)

FOREIGN PATENT DOCUMENTS

| | | |
|---|---|---|
| CN | 201 312 372 Y | 9/2009 |
| EP | 1 895 811 A2 | 3/2008 |

(Continued)

OTHER PUBLICATIONS

PCT International Search Report and Written Opinion of the International Searching Authority for PCT/US2013/077633 mailed Mar. 17, 2014.

*Primary Examiner* — Davetta W Goins
*Assistant Examiner* — Phylesha Dabney
(74) *Attorney, Agent, or Firm* — Blakely, Sokoloff, Taylor & Zafman LLP

(57) ABSTRACT

A first driver housing and a second driver housing are positioned inside an earbud cup. The first driver housing has a rear side, a front side, a top face a bottom face, and a sound output tube extending from the front side. The second driver housing has a top side, a bottom side, a front face, a rear face, and a sound output opening formed in the front face of the second housing with essentially no tube extending therefrom. The rear face of the second housing is disposed a) adjacent to the front side of the first housing, and b) behind an exit of the sound output tube of the first housing. Other embodiments are also described and claimed.

24 Claims, 10 Drawing Sheets

(56) References Cited

U.S. PATENT DOCUMENTS

| | | | | |
|---|---|---|---|---|
| 8,166,502 | B2 * | 4/2012 | Hsiao | 725/38 |
| 8,180,094 | B2 * | 5/2012 | Harvey | 381/380 |
| 8,194,911 | B2 | 6/2012 | Dyer et al. | |
| 8,213,645 | B2 * | 7/2012 | Rye et al. | 381/151 |
| 8,238,596 | B2 * | 8/2012 | Blanchard et al. | 381/380 |
| 8,488,831 | B2 * | 7/2013 | Saggio et al. | 381/380 |
| 8,515,103 | B2 * | 8/2013 | Mei et al. | 381/309 |
| 2006/0133631 | A1 * | 6/2006 | Harvey et al. | 381/312 |
| 2006/0133636 | A1 | 6/2006 | Harvey et al. | |
| 2007/0036385 | A1 * | 2/2007 | Harvey et al. | 381/388 |
| 2007/0053540 | A1 * | 3/2007 | Harvey | 381/380 |
| 2007/0223735 | A1 * | 9/2007 | LoPresti et al. | 381/99 |
| 2008/0063223 | A1 | 3/2008 | van Halteren et al. | |
| 2009/0147981 | A1 * | 6/2009 | Blanchard et al. | 381/380 |
| 2009/0220113 | A1 * | 9/2009 | Tiscareno | 381/309 |
| 2011/0058702 | A1 * | 3/2011 | Saggio, Jr. | 381/380 |
| 2011/0058703 | A1 * | 3/2011 | Saggio, Jr. | 381/380 |
| 2011/0158440 | A1 | 6/2011 | Mei et al. | |
| 2012/0008814 | A1 | 1/2012 | Alwicker et al. | |
| 2012/0121119 | A1 * | 5/2012 | Saggio et al. | 381/380 |
| 2012/0140975 | A1 * | 6/2012 | Chang et al. | 381/380 |
| 2013/0028437 | A1 * | 1/2013 | Bruss et al. | 381/74 |
| 2013/0058508 | A1 * | 3/2013 | Oosato et al. | 381/162 |
| 2013/0070022 | A1 * | 3/2013 | Ogawa et al. | 347/37 |
| 2014/0140565 | A1 * | 5/2014 | Liu | 381/380 |
| 2014/0153737 | A1 * | 6/2014 | Geschiere et al. | 381/74 |
| 2014/0205131 | A1 * | 7/2014 | Azmi et al. | 381/380 |

FOREIGN PATENT DOCUMENTS

| | | | |
|---|---|---|---|
| EP | 2 146 521 | A1 | 1/2010 |
| GB | 2486688 | A | 6/2012 |

* cited by examiner

MULTI-DRIVER EARBUD

An embodiment of the invention relates to earphones that fit within the use's ear canal, also referred to as earbuds, that have multiple speaker drivers and a cross-over network. Other embodiments are also described.

BACKGROUND

In-ear earphones or earbuds continue to be popular since they can deliver reasonable sound quality while having a conveniently small profile and being lightweight. Professional quality in-ear earphones often use balanced armature drivers that can be designed to faithfully reproduce either low frequency sound or high frequency sound. However, balanced armature drivers generally do not operate consistently across the entire audible frequency range. To overcome this limitation, multiple balanced armature drivers have been suggested for within an in-ear earphone. A crossover network is also provided in that case, to divide the frequency spectrum of an audio signal into two regions, that is, low and high, and a separate driver is used to reproduce the sound in each region. Professional quality earphones may also have an ear tip or sleeve, which can be either custom molded or generic, that allows for a snug fit that is intended to acoustically seal against the ear canal of the user, which enables a higher quality low frequency or bass sound to be heard, in addition to lower acoustic background noise.

A typical sealing-type earbud has a housing or cup in which a driver is housed. A silicone or rubber boot that has sound passages formed therein fits over the front of the driver, to hold the driver in place, and to ensure that the driver output is sealed relative to the outside environment. A cap that is made of a rigid material (in contrast to the material of the boot) is then pushed onto the boot to essentially complete a rigid earphone housing. A spout extends out the front of the cap, and is aligned with the passages in the boot so as to receive the sound produced by the drivers. A flexible ear tip is then fitted to the spout. While this arrangement has proven to be effective in terms of presenting reasonable sound performance while being sufficiently small and light enough for everyday consumers use with various activities, a generic, that is a non-custom, in-ear earphone that is suitable for high volume manufacture that provides good sound fidelity across most, if not all, of the audible frequency range of a typical consumer presents a challenge, particularly in terms of packaging multiple drivers inside the tight confines of the earbud housing.

SUMMARY

An embodiment of the invention is an earbud having an earbud cup in which are disposed a first driver housing and a second driver housing. The first driver housing has a rear side, a front side, a top face, a bottom face, and a sound output tube extending outward from the front side. The second driver housing has a top side, a bottom side, a front face, a rear face, and a sound output opening formed in the front face but essentially no sound output tube. The rear face of the second housing is disposed a) adjacent to the front side of the first housing and b) behind an exit of the sound output tube of the first housing.

In one case, in the first housing, the top face has a larger area than either the rear side or the front side. Also, in the second housing, the front face has a larger area than either the top side or the bottom side. Examples of such housings are parallelepiped-shaped drivers in which the diaphragm in each housing may be disposed substantially parallel to the faces rather than the sides of the housing. Each driver housing may contain a single balanced armature driver, to produce its respective sound.

In another embodiment, an earbud cup contains a low driver housing, a middle driver housing, and a high driver housing. The three housings are arranged relative to each other such that a more compact envelope results that is able to produce sound with good fidelity. In particular, the middle and the low driver housings are stacked on top of each other in the sense that a top face of the low housing lies essentially flat against a bottom face of the middle housing, while the high housing is oriented such that its rear face is disposed adjacent to the front side of the low housing and behind an exit of a sound output tube of the middle housing. A sound output opening is formed in the front face of the high housing, but essentially no sound output tube.

In one case, the high driver housing houses a single balanced armature motor that is coupled to drive a diaphragm which is oriented substantially parallel to the front face and also the rear face of the high housing, while the low and middle driver housings may have either balanced armature or dynamic moving coil motors, or a mix of the two. Such an arrangement works particularly well when the top face of the low driver housing has a greater area than either the rear side or the front side of the low driver housing, and the bottom face of the middle driver housing has greater area than either its front or rear sides. In one embodiment, each of the low and medium housings is essentially a parallelepiped (e.g., the rectangular shape of a matchbox) where the two opposing faces each have larger area than any of the sides of the housing.

In one embodiment, the driver housings fit into a boot that may be flexible and resilient enough to hold the driver housings as a single assembly. Two passages are formed in the boot, which are aligned with the two sound output ports of the driver housings, respectively. In the embodiment where the earbud has at least three driver housings, the high driver housing may be given its own passage in the boot, whereas the low and medium driver housings have to share the other passage. In another embodiment, the boot has a third passage that is dedicated to the low housing, where a further sound output tube extends out and upward from a left side or right side of the low driver housing and then connects with the dedicated passage in the boot. In that case, each of the three driver housings uses its own or respective passage through the boot.

To complete the earbud housing, a cap that has an opening aligned with and large enough to encompass the exits of the passages in the boot is provided. The cap may be made of a more rigid material than the boot, e.g. similar to the material of which the housing or cup is made. The boot may fit into the front face of the cap such that the cap entirely surrounds the boot; the cap can then be snap-fitted or otherwise joined to the front of the cup. A spout can extend forward from the cap where it is aligned with the cap opening. The spout may present an uninterrupted space that communicates with the exit ports of the first and second passages at the cap opening. A flexible ear tip can fit onto the spout, in order to provide the user with a snug and acoustically sealed in-ear earphone experience. In such an embodiment, the spout may have an equivalent radius to length ratio that is in the range 1/4 to 1/7 plus a constant. This particular range may work effectively with the relatively compact arrangement of the three driver housings with either the twin passage or triple passage versions of the boot.

In yet another embodiment, the arrangement of the driver housings and the way they fit into the boot is such that there is space to house an inertial sensor integrated circuit (e.g., a digital accelerometer chip) located below the bottom face of the low driver housing, and behind the boot. The inertial sensor may be used as part of a non-acoustic microphone to detect speech of the user wearing the earphone. In addition, an acoustic microphone, which can be used as an error microphone in an active noise cancellation system, may be fitted in the boot. A further hole may be formed in the boot that enables sound from the space that is between the front face of the boot and the rear face of the cap to reach an acoustic entry of the microphone. The hole may be positioned such that the entry of the acoustic microphone lies directly behind it, for example where the acoustic microphone is located below the bottom side of the second driver housing (or of the high driver housing), and in front of the front side of the first driver housing (or of the low driver housing). This enables the acoustic microphone to be used not just as an error microphone for an active noise control system, but also as a component of a near-end user or talker speech pickup system. This system may be particularly effective when outside acoustic background noise is being passively reduced by the sealing characteristics of the flexible ear tip.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, a single figure may depict multiple embodiments of the invention or aspects of different embodiments, as explained in the Detailed Description, in order to limit the total number of figures (for conciseness).

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
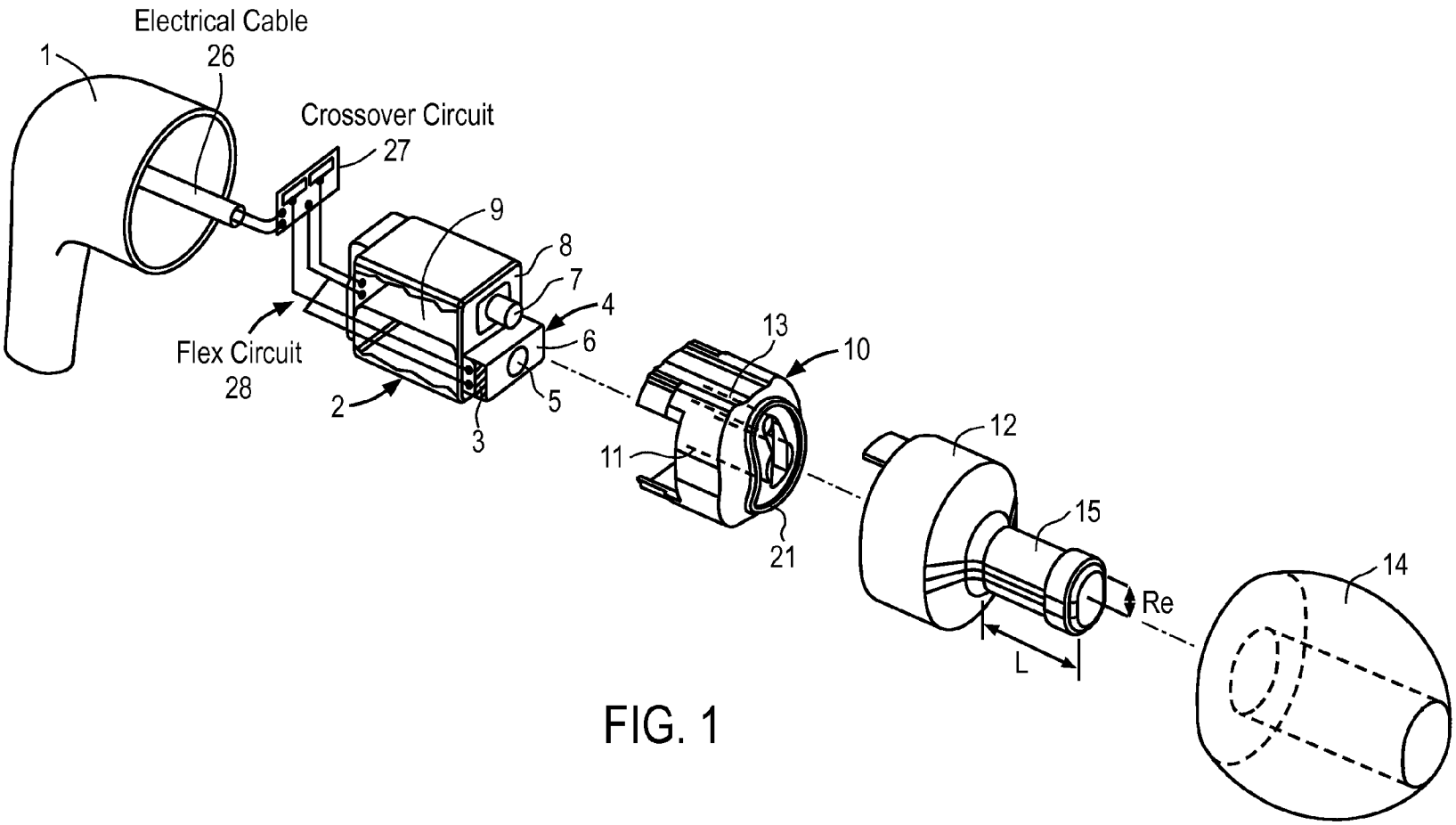
FIG. 1 is an exploded view of an earbud having a multi-way driver, with first and second driver housings and a cross over circuit, in accordance with an embodiment of the invention.

Beginning with FIG. 1 this is an exploded view of a two-way earbud having a first driver case or housing 2 and a second driver case or housing 4. At the rear is an earpiece housing 1, also referred to as an earbud cup, which may be made of a relatively rigid material such as molded plastic, for example. The earpiece housing 1 can serve to house different versions of a multi-way driver assembly, including one in which there are two driver housings 2, 4 and another in which there are three driver housings (see FIG. 2A). It also serves to encase an electrical cable whose near end terminates at a cross over circuit 27 inside the housing 1, and whose far end terminates at an accessory connector (e.g., a tip ring ring sleeve, TRRS, headset plug—not shown). The cable serves to route an original, electrical audio signal from an external device (not shown) to the input of the crossover circuit 27. In one embodiment, low pass filter and high pass filter outputs of the crossover circuit 27 are electrically connected to respective electrical terminals of the first and second driver housings 2, 4, respectively, by a flex circuit 28. In another embodiment the crossover circuit 27, or any one or more of its constituent electronic filters, may be omitted when for example the desired low pass behavior and/or high pass behavior can be achieved acoustically by suitably tuning the driver itself. In both of those embodiments, the first driver housing 2 may be referred to here as being part of a low frequency driver, and the second driver housing 4 is part of a high frequency driver.

The drivers having the housings 2, 4 together can produce the sound content that is represented in the original audio signal. The sound content may be, for example, music from a digital music or movie file that is either locally stored in the external device or is being streamed from a remote server, and is being processed and converted into the original audio signal by an audio processor (not shown). Alternatively, the sound content may be speech of a far-end user of a communications system that includes the external device, during a voice or video call with a near-end user who is wearing the earbud. Examples of the external device include a smartphone, a portable digital media player, a tablet computer, and a laptop computer.

The earbud cup or housing 1 has an open front end as shown which receives a multi-way driver assembly that, in this case, has at least two distinct driver housings, namely the first driver housing 2 and the second driver housing 4. In one embodiment, each driver housing is generally a polyhedron with flat faces and straight edges, although more generally some of the faces and the edges may be curved. There is a manufacturing advantage when the faces and edges of the driver housings are flat and straight, respectively. In the particular example depicted in FIG. 1, each driver housing forms essentially a parallelepiped having a respective main sound output port formed in a wall of each parallelepiped. However, the descriptions below to "faces" and "sides" of the driver housings are also applicable to other polyhedrons. Also, for the sake of clarity, the references to "front" and "rear", "left" and "right", and "vertical" and "horizontal" are used only to refer to relative orientation and are not to be construed as having an absolute or restricted meaning.

For the first driver housing 2, a sound output port 7 is formed as a tube that extends outward of an exterior wall which is referred to as front side 8, as shown. In one embodiment, the sound output port 7 is the main sound output port of the driver housing 2. A rear side of the driver housing 2 is disposed further rearward in the earpiece housing 1, and in the case of the parallelepiped shown is substantially parallel to the front side 8. In that case, a left side, a right side, a top face and a bottom face complete the enclosure. A sound radiating member or diaphragm 9 lies inside the driver housing 2 and may be oriented substantially horizontal as shown, i.e. substantially perpendicular to the sides of the driver housing, or substantially parallel to the top face or the bottom face of the driver housing 2. This is in contrast to the substantially vertical orientation of a diaphragm 3 that is in the second driver housing 4. As an alternative, the diaphragm 9 may be oriented substantially vertical, i.e. substantially parallel to the sides (not faces) of the driver housing 2. A motor inside the housing 2 (not shown) is attached to vibrate the diaphragm 9 to produce sound, in accordance with the low pass filtered audio signal coming from the cross over circuit 27.

The second driver housing 4 is also essentially a parallelepiped enclosure in this example, formed of a front face 6, a rear face, left and right sides, and top and bottom sides. The diaphragm 3 inside is substantially parallel to the front face 6. The housing 4 is oriented such that its main sound output port is formed in the exterior housing wall referred to as front face 6, while the rear face (which is opposite the front face 6 in this case) is disposed adjacent to the front side 8 of the housing 2. Here, adjacent may mean no intervening space or air gap between the rear face and the front side, although there could be one or more layers that join the two, for example a layer of adhesive material, or a layer of vibration dampening material. The rear face of the second driver housing 4 is also positioned behind an exit of the sound output port 7 of the first housing 2.

The sound output port 5 of the second driver housing 4 is a hole or opening essentially without any sound output tube extending therefrom. In the particular embodiment shown, while the sound output port 7 of the first housing 2 is a tube that actually extends forward as shown, forming a short spout as depicted, there is no such spout for the sound output port 5 of the second housing 4. The sound output port 5 may be essentially flush with the front face 6, which lies flat against the interior face of a boot 10. This helps reduce the depth (in the forward-rearward direction) of the multi-way driver assembly, and may also increase sound output (loudness) in the relevant frequency range for a particular spout design (e.g., having a certain $R_e$/L ratio).

The two-driver housings 2, 4 may be gripped, held or supported by a 2-port boot 10, which may be made of a resilient material in contrast to the more rigid material used for the earpiece housing 1. Examples include a silicone or rubber-type of material that can stretch and is resilient so as to grasp the outside of the driver housings 2, 4 once the latter have been fitted into the mouth of the boot. The 2-port boot 10 has first and second passages 13, 14 formed in its sole portion as shown, and these are aligned with the sound output ports of the driver housings 2, 4 when they have been fit into the boot 10. An example of the 2-port boot 10 is depicted in FIGS. 3A, 3B.

The front face or surface of the sole of the boot 10 has an outer ridge 21 formed thereon that may completely surround the exits of the passages 13, 11 as shown, so as to provide an acoustic seal when pressed against an inside face of a cap 12 (see FIG. 1). A mixing space 36 may be formed in a cutback portion of the front face where sounds exiting from two passages 13, 11 can mix while being isolated from ambient noise thanks to being surrounded by the outer ridge 21.

Figure 3A:
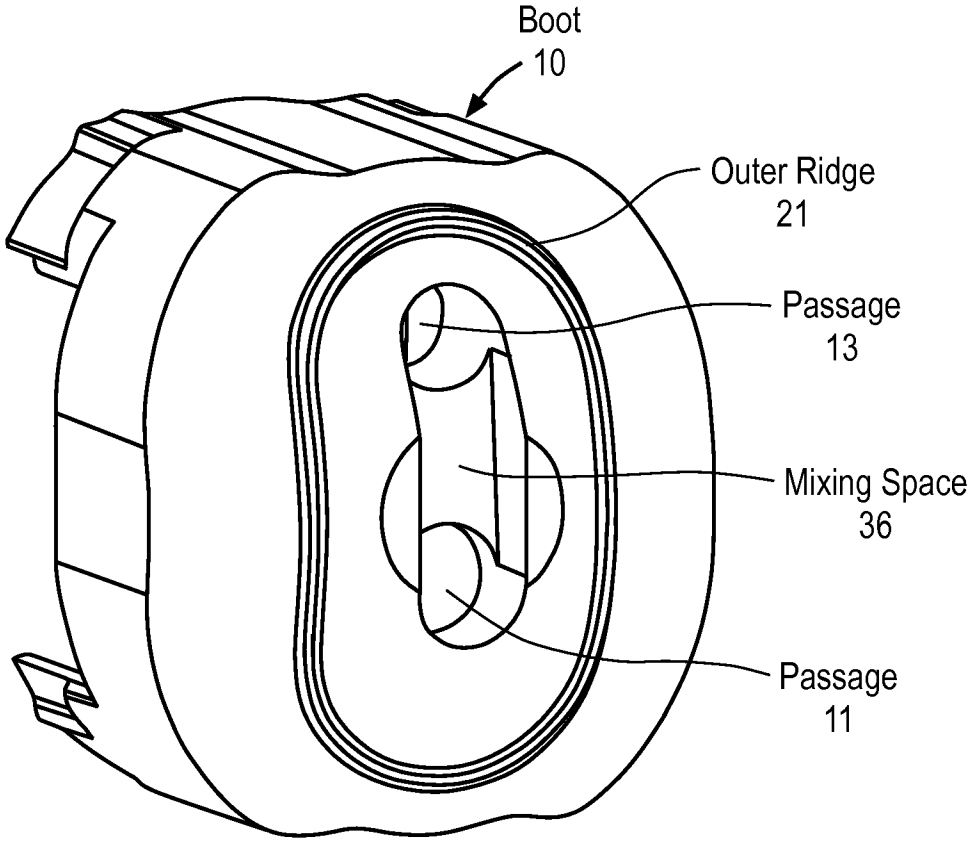
FIG. 3A is a front perspective view of a boot having two ports or passages.
Figure 3B:
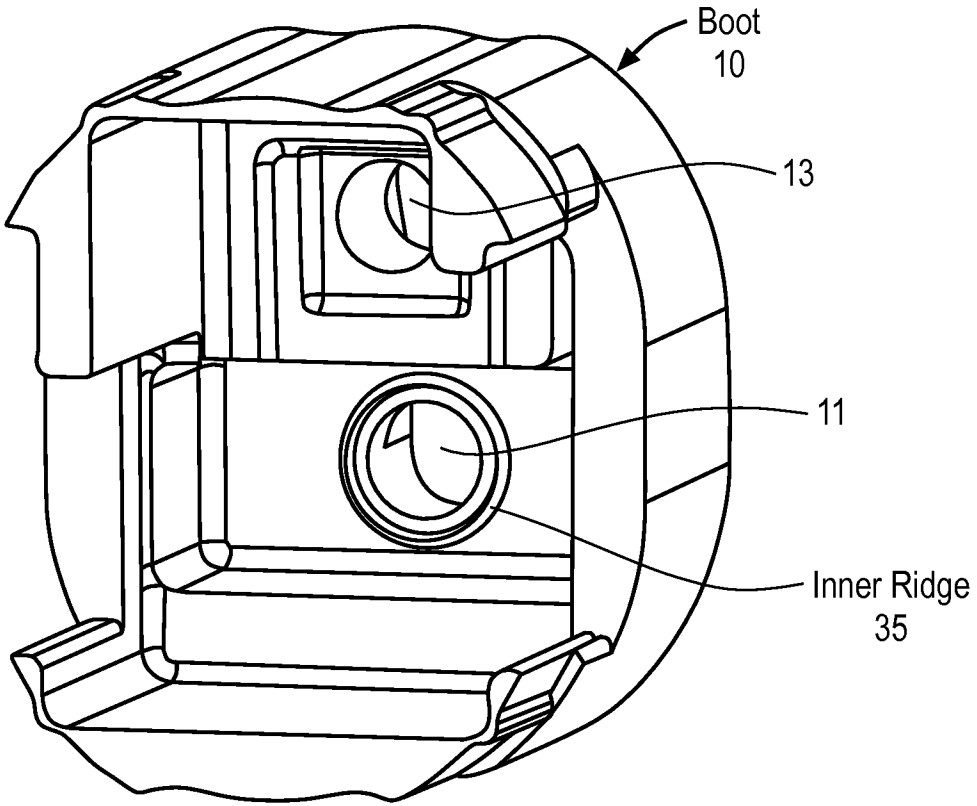
FIG. 3B is a rear perspective view of the boot of FIG. 3A.

Referring to FIG. 3B, which shows a perspective rear view of the two-port boot 10 of FIG. 3A, it can be seen that an inner ridge 35 is formed on the inner face of the boot 10, that entirely surrounds the passage 11. A purpose of the inner ridge 35 is to prevent ambient sound from leaking into the passage 13 and corrupting the sound produced by the high frequency driver (housing 2). Note that a similar ridge may not be needed for the passage 13, due to the use of the sound output port 7 being an extended tube that may present more acoustic isolation due to its contact with the wall of the passage 13 (than simply the opening formed as the sound output port 5 of the high frequency driver).

The boot 10 may be sized so that the cap 12 can fit over the front face of the boot 10, so that resilience of the material of the boot 10 serves to push against the inner side of the cap 12, thereby maintaining the boot in place. For example, the front face and sides of the boot 10 can be sized to fit snuggly into the interior cavity of the cap 12 (entering from the rear of the cap as shown in FIG. 1). The cap 12 may be made of a more rigid material than the boot 10, for example, similar to the material used for the earpiece housing 1, e.g. in molded plastic. The cap 12 also serves to complete the relatively rigid earpiece housing, by for example being snap-fitted or otherwise snuggly fitted against the open end of the earpiece housing 1.

The cap 12 has an opening in its face that is aligned with and has an area that is large enough to communicate with the sound mixing space 36 and the exits of the first and second passages 13, 11 in the boot 10. The opening however is smaller than the area spanned by the outer ridge 21 so that ambient/background noise is less likely to enter the cap opening. A spout 15 extends forward from the front surface of the cap 12 where it is aligned with the cap opening. The spout 15 may be a generally circular sound tube (e.g., having an elliptic cross section), which may or may not be tapered along its length, and presents an uninterrupted space that communicates with the mixing space 36 and the exits of the first and second passages 13, 11 (through the cap opening). The spout 15 may be tuned for delivering improved sound quality by for example having its ratio $R_e$/L (equivalent radius, $R_e$, to length, L) in the range 1/4 to 1/7 plus a constant, with the understanding that increasing L may yield diminishing returns.

In the particular embodiment depicted in FIG. 1, the earbud is a sealing-type earbud in which an ear tip or sleeve 14 is provided that is attached to the cap 12, for purposes of acoustically sealing against the ear canal of a user. The ear tip 14 may be made of a flexible foam-type material or other suitable material that can conform to the shape of the user's ear canal wall, to thereby provide an acoustic seal that, for example, entirely surrounds the passage (shown in dotted lines) that is formed in the ear tip 14. That passage is designed to receive the front portion of the spout 15 therein. A suitable mechanism is also provided to maintain the ear tip 14 attached to the cap 12 including the spout 15, when the user repeatedly inserts and removes the earbud from her ear.

In the embodiment of FIG. 1, the second driver housing 4 may be that of a balanced armature driver, in which the sound output port 5 (an opening such as a slot or round hole) is formed in the front face 6, which is part of the exterior wall of the driver housing 4. In one embodiment, the housing wall entirely encloses a chamber in which a diaphragm 3 is positioned so as to be substantially parallel to the front face 6 as shown. The diaphragm 3 is the primary sound producing or radiating member and will vibrate according to an audio signal that is converted by a motor. The audio signal that drives the balanced armature motor may be a high pass filtered version of the original audio signal being delivered to the earbud by the electrical cable 26—see FIG. 1. The cross over circuit 27 performs high pass filtering upon the original audio signal, at one of its outputs, and may also perform low pass filtering upon the original audio signal, at another one of its outputs, to achieve operation of the two-way earbud depicted in FIG. 1. The low pass filtered version is sent to the input electrical terminal of the first driver housing 2. Note that in a three-way earbud (such as that shown in FIG. 2A), the cross over circuit 27 may also perform bandpass filtering at a further output, and the bandpass filtered version is sent to the input electrical terminal of a third driver housing (the midrange housing 18 in FIG. 2A). As an alternative, the cross over circuit 27 may be omitted for a particular driver, such that the original audio signal in that case may be routed directed to the driver input terminal in the housing of that driver.

Figure 2A:
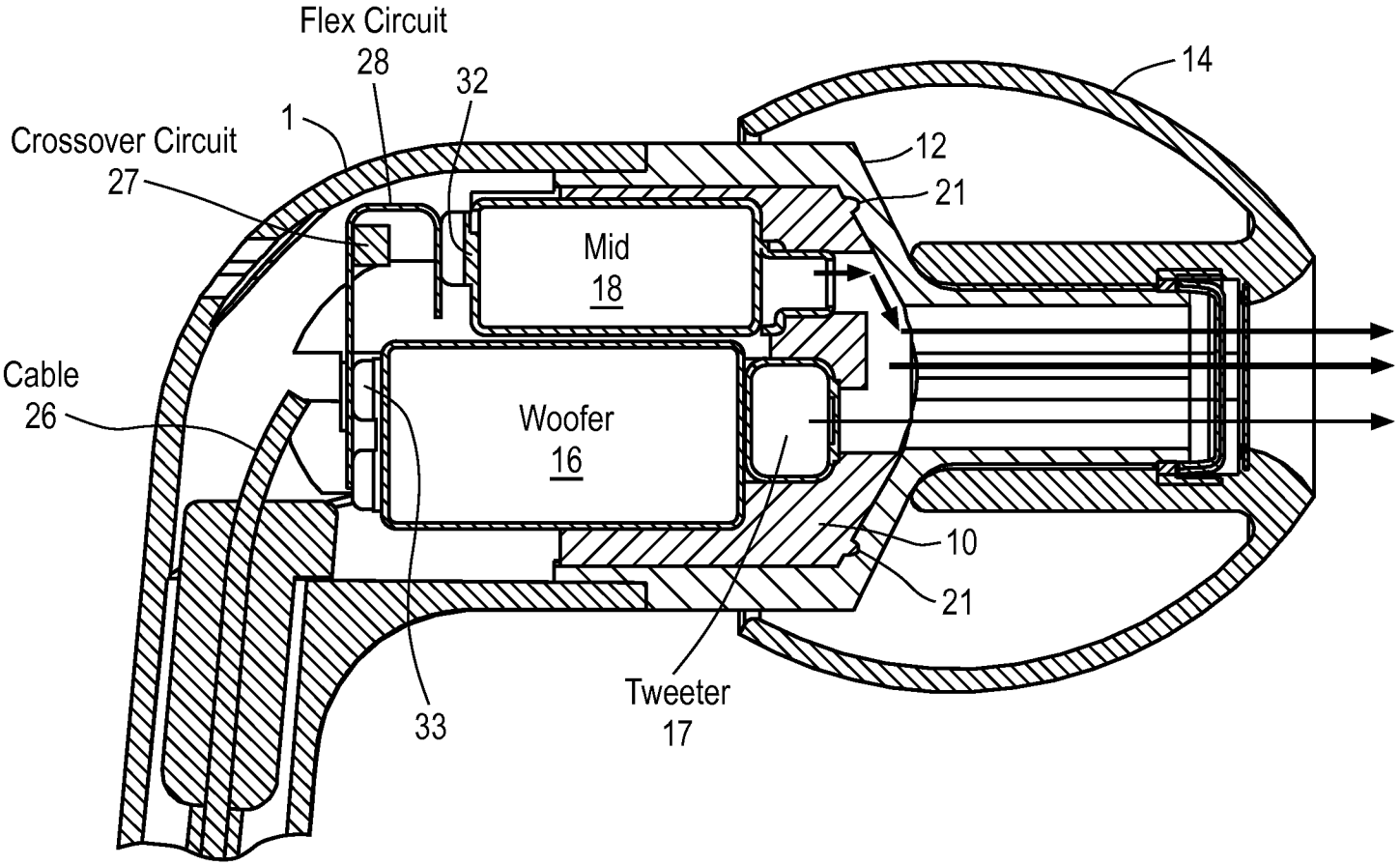
FIG. 2A us a cutaway view of an earbud having a three-way driver.

Turning now to FIG. 2A, a section view of a three-way earbud is shown, having a three-way driver in which a woofer housing is provided that larger than a midrange housing which in turn is larger than a tweeter housing. In this case, the earbud housing 1 and the cap 12 may be substantially similar to those of the two-way earbud shown in FIG. 1A. In addition, the ear tip 14 may also be similar. As a further similarity, the two-port boot 10 may also be reused with the three-way driver, where the upper passage 13 is shared by both a low frequency driver, namely woofer 16, and a midrange driver 18. This may be achieved by providing a sound output port in the top face of the housing of the woofer 16, which is aligned with an input port formed in the bottom face of the housing of the midrange 18 as shown. The thickest arrows depicted in FIG. 2A represent the low frequency or bass sound produced by the woofer 16, while the middle thickness arrows represent the midrange sound produced by the midrange driver 18, and the thin arrows represent the high frequency sound produced by a tweeter 17. The high frequency sound from the tweeter 17 is given its own dedicated passage 11 in the two-port boot 10 as shown.

The low driver housing, namely the housing of the woofer 16, has a rear side in which a driver input electrical terminal 33 is exposed and connected to the flex circuit 28, a front side, a top face, and a bottom face. The low driver housing is stacked flat below the housing of the midrange driver 18, where the latter also has a rear side in which a driver input electrical terminal 32 is exposed and connected to the flex circuit 28, a front side, a top face and a bottom face. In addition the housing of the midrange 18 has the sound output port 7 that extends from the front side (see also FIG. 2B), as an acoustic tube through which both low frequency and midrange sound is delivered into the mixing space 36 of the boot 10—see FIG. 3A. The stacking of the midrange 18 and the woofer 16 may also be described as the bottom face of the housing of the midrange 18 being disposed adjacent to the top face of the housing of the woofer 16.

To complete the three-way driver assembly, the housing of a tweeter 17 is oriented such that its sound output port 5 is formed as merely an opening in the front face 6 of the housing, while the rear face of the housing is adjacent to the front side 19 of the housing of the woofer 16. In addition, the rear face of the tweeter housing is positioned behind an exit of the sound output tube of the housing of the midrange 18. In this configuration, the exit of the midrange sound output tube is substantially aligned with the front face of the tweeter housing, in order to reduce the depth of the three-way driver assembly. This arrangement is also depicted in FIG. 2B, where the sound output port 7 emerges from the front side 8 of, in this case, the housing of the midrange 18, whereas the sound output port 5 is formed in the front face 6 of the housing of the tweeter 17.

Figure 2B:
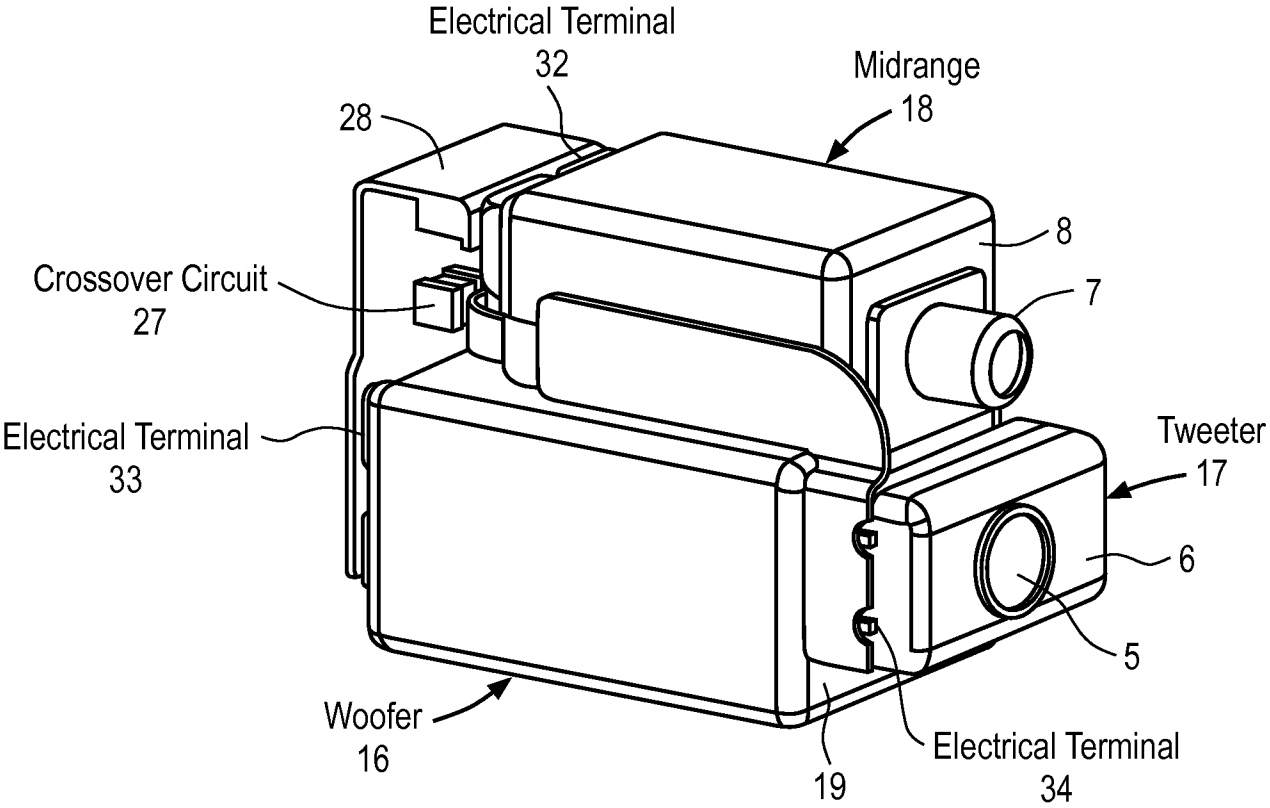
FIG. 2B is a perspective view of the three-way driver assembly depicted in FIG. 2A.

Note that in the embodiment of FIG. 2A and FIG. 2B, each of the driver housings is essentially a parallelepiped. For example, the woofer housing top face has a greater area than either the rear side or front side of its housing, as does the bottom face. In addition, each of the top face and the bottom face of the midrange housing may have a greater area than any of the sides. As to the housing of the tweeter 17, each of its front face and rear face has larger areas than the left and right sides, though not necessarily larger than the areas of the top and bottom sides. With such an arrangement, in one embodiment, the diaphragm 3 of the tweeter 17 is oriented substantially vertically as shown, or substantially parallel to the front face or the rear face of the tweeter housing, while the diaphragms 9*b*, 9*a* of the midrange 18 and woofer 16, respectively, are substantially horizontal, or parallel to the top and bottom faces of those housings. See FIG. 4A which shows a section view of a three-way driver assembly and, in particular, the diaphragm 3 in the tweeter 17, the diaphragm 9*a* in the woofer 16, and the diaphragm 9*b* in the midrange 18.

FIG. 2A and FIG. 2B also show how the flex circuit 28 has connected to it a crossover circuit 27 which in this case has three outputs providing a low pass filtered version, a bandpass filtered version, and a high pass filter version of the original audio signal being delivered to the earbud through the cable 26. As seen in FIG. 2B, the flex circuit 28 in this embodiment has two sections, namely one section that runs substantially vertically and connects the electrical terminal 33 of the woofer 16 to the low pass filter output, and the electrical terminal 32 of the midrange 18 to the bandpass filter output, whereas another section that routes a wire from the electrical terminal 34 of the tweeter 17 rearward, by running along the top face of the woofer housing as shown, connects to the high pass filter output. Note also how a section of the flex circuit 28 runs along the top face of the woofer housing and along the left side of the midrange housing, while the right side of the midrange is positioned closer to the right side of the woofer housing as depicted in FIG. 2B. This arrangement is also helpful in reducing the volume of space needed inside the earbud housing 1.

In one embodiment, still referring to the three-way earbud of FIG. 2A and the three-way driver assembly of FIG. 2B, the tweeter 17 may have inside its housing a balanced armature motor that is coupled to drive the diaphragm 3. As to the motors used in the woofer 16 and the midrange 18, these may or may not be balanced armature types, as one or both of them may alternatively be of the electrodynamic variety.

Figure 4A:
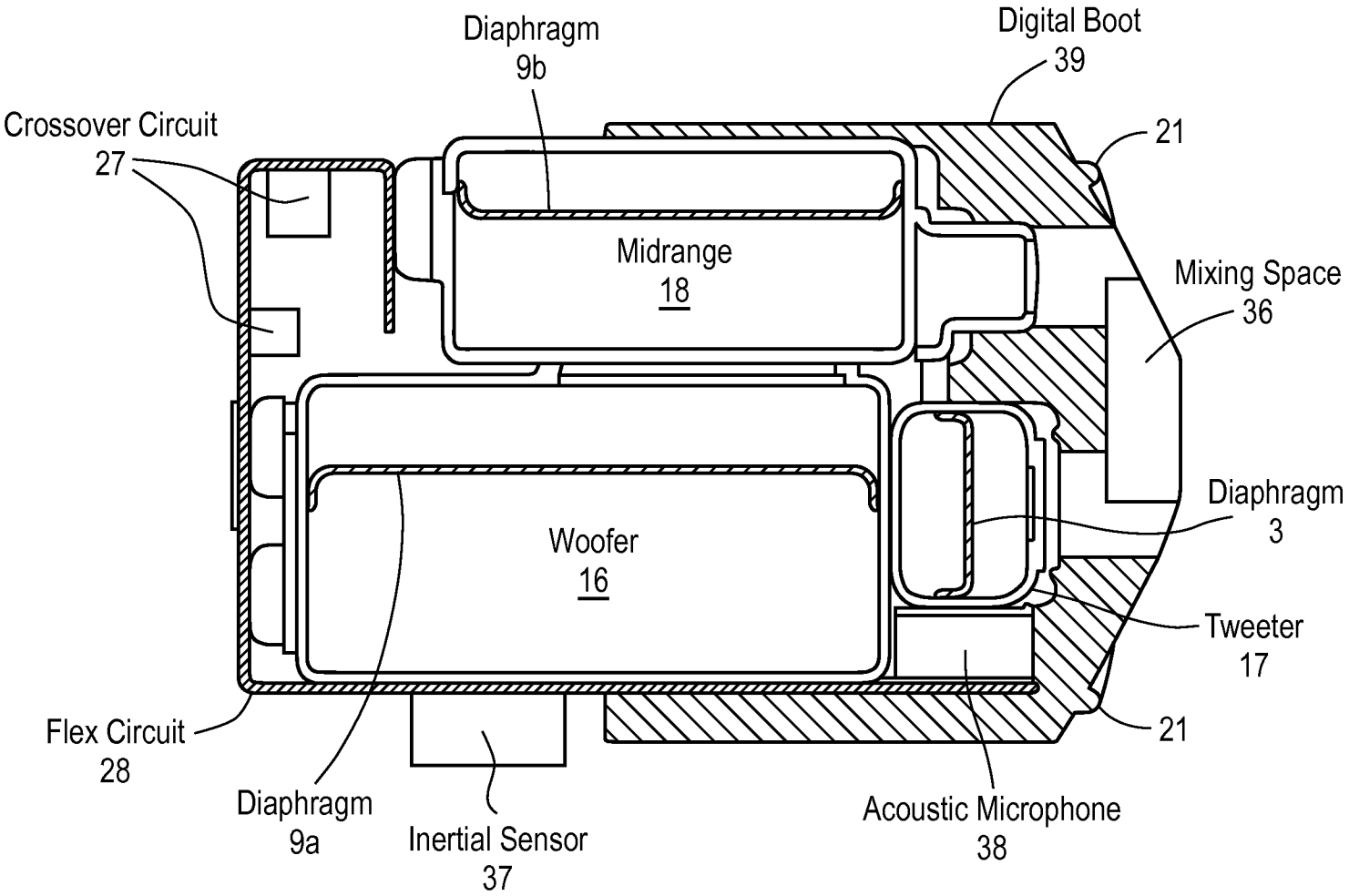
FIG. 4A is a cutaway view of an assembly having three driver housings, a boot, an accelerometer and an acoustic microphone, to be installed into an earbud housing.
Figure 4B:
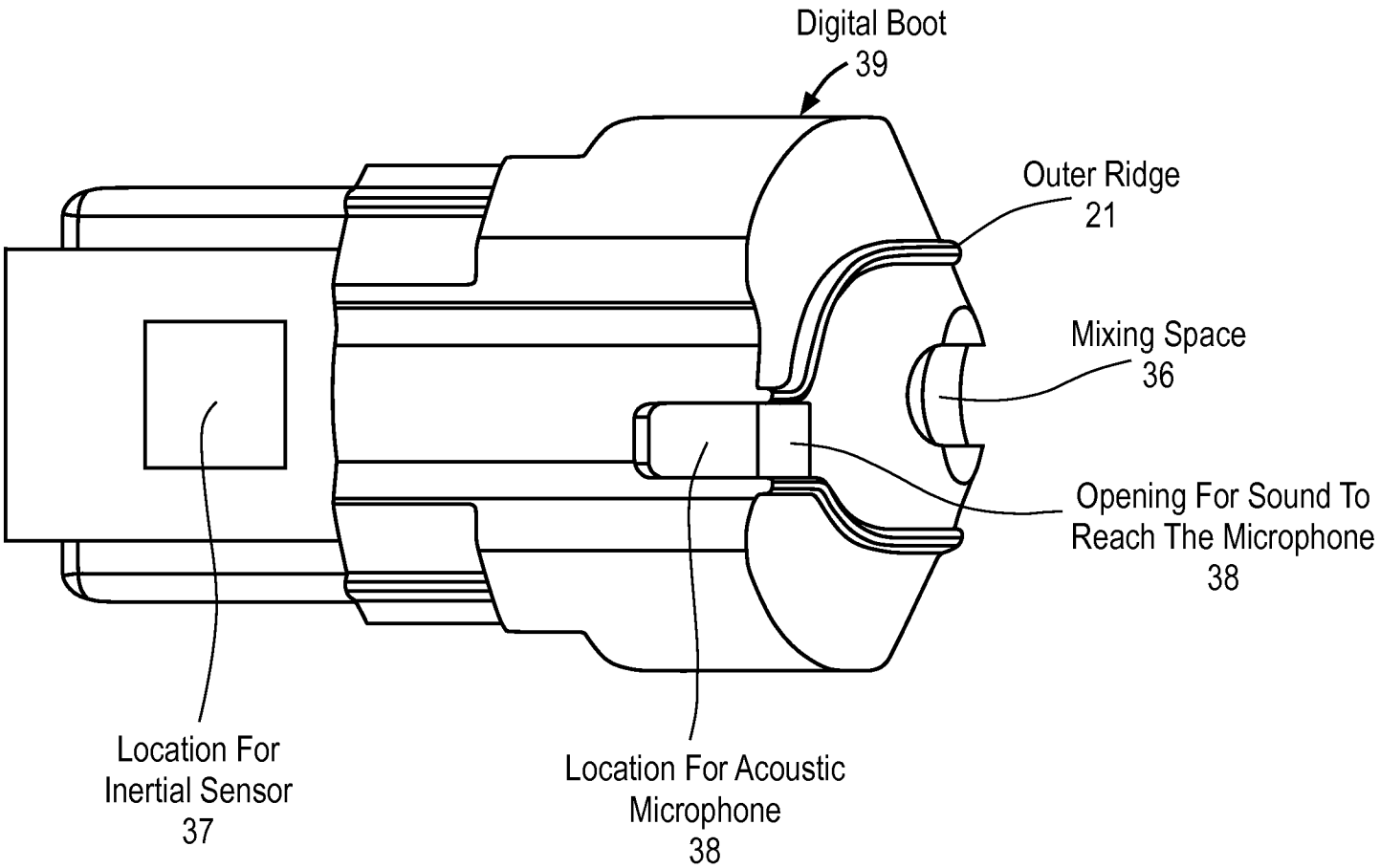
FIG. 4B is a bottom view of the assembly of FIG. 4A.

Turning now to FIG. 4A, a section view of a three-way driver assembly is shown that is combined with an acoustic microphone 38. The latter may be used as part of a digital acoustic pickup circuit (not shown) that may include analog to digital conversion circuitry that is connected to the flex circuit 27 and may be located near the crossover circuit 27. The microphone 38 may be fitted into a so-called "digital" boot 39. The latter may be essentially similar to the 2-port boot 10 described above except for the creation of an additional opening or hole as seen in FIG. 4B and in FIG. 4C that enables sound from the mixing space 36, which is between the front face of the boot 39 and the rear face of the cap 12, to reach an acoustic entry of the microphone 38. In the example shown here, the microphone 38 is located below the bottom side of the housing of the tweeter 17, and in front of the front side of the housing of the woofer 16. This arrangement is particularly space efficient since a bottom section of the flex circuit 28 can electrically connect with the microphone 38, running rearward from an electrical output terminal of the microphone 38 along the bottom face of the woofer housing and then upward to connect with the terminal of the woofer 16 and then onward to connect with the terminal of the midrange 18. The digitized audio signal picked up by the microphone 38 represents the sound in the mixing space 36 which is essentially the sound being produced in the ear cavity of the user wearing the earbud. This digitized audio signal may be delivered through the cable 26—see FIG. 2A—to an active noise control or cancellation (ANC) processor that may be implemented in the external device (which is simultaneously producing the original audio signal that is being sent to the 3-way driver for conversion into sound). In that case, the microphone 38 may be referred to as an error microphone used by the ANC processor to pick up the residual acoustic noise that may be heard by the user during operation of ANC processing.

Figure 4C:
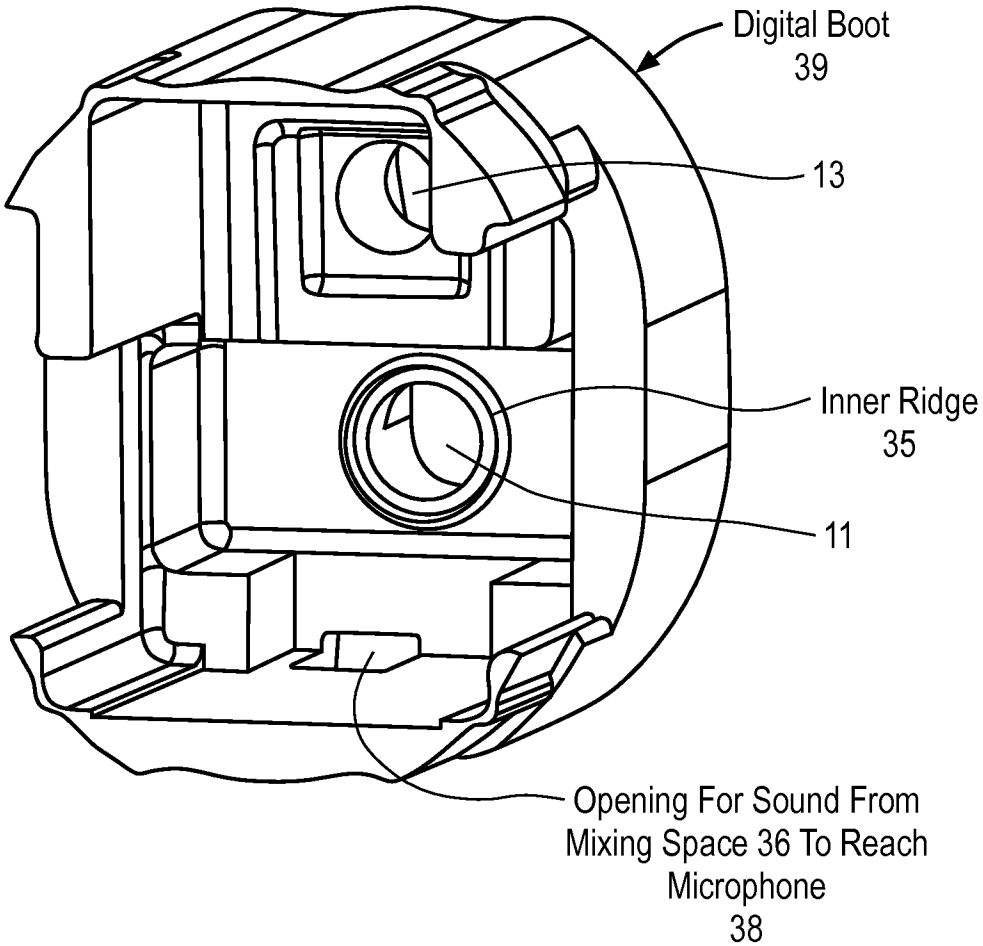
FIG. 4C is a rear perspective view of the boot used in the embodiments of FIGS. 4A and 4B, showing a further hole for coupling to an acoustic entry of the microphone.

Referring to FIG. 4B and FIG. 4C, the opening for sound to reach the microphone 38 has a through-hole section, i.e. a hole made through the wall of the boot 39, and a groove section, i.e. a groove made in the outer surface of the wall of the boot wall that connects the through-hole section to an area in front of the front face of the booth 39 that lies within the periphery of the outer ridge 21. This can best be seen in the bottom view of the boot 39 shown in FIG. 4B. In order to achieve such a groove section, a corresponding portion of the outer ridge 21 has been removed (or not formed) as seen in FIG. 4B. This in turns allows sound from the mixing space 36 to reach the location for the acoustic microphone 38, by diffusing across the front face of the booth 39 and then passing along the groove section and then the through-hole section, before arriving at the acoustic entry of the microphone 38.

Referring back to FIG. 4A and FIG. 4B, these figures also show a further embodiment of the invention in which an inertial sensor 37 (e.g., a digital accelerometer chip) may be connected to the outer face of the flex circuit 27 (while the microphone 28 is connected to its inner face), while being located below the bottom face of the woofer 16 and behind the boot 39. As such, the bottom of the inertial sensor 37 may be directly in contact with the inner surface of the exterior wall of the earbud housing 1, so as to better pick up vibrations of the exterior wall of the earbud housing 1 that have been caused by bone conduction when the earbud wearer is speaking. To improve performance, vibration dampening or absorbing material may be added between the inertial sensor 37 and the bottom face of the woofer 16, so that pick up of low frequency vibrations being produced by the woofer 16, as it is converting the original audio signal, is attenuated. The flex circuit 27 is used here to route the digitized inertia signal (from the inertial sensor 37) to the cable 26 (see FIG. 2A), which in turn routes the signal to the external audio device. Within the external device, the inertia signal can be processed by a combined acoustic and non-acoustic voice activity detection processor, to determine whether or not the user (who is wearing the earbud) is speaking.

Figure 5:
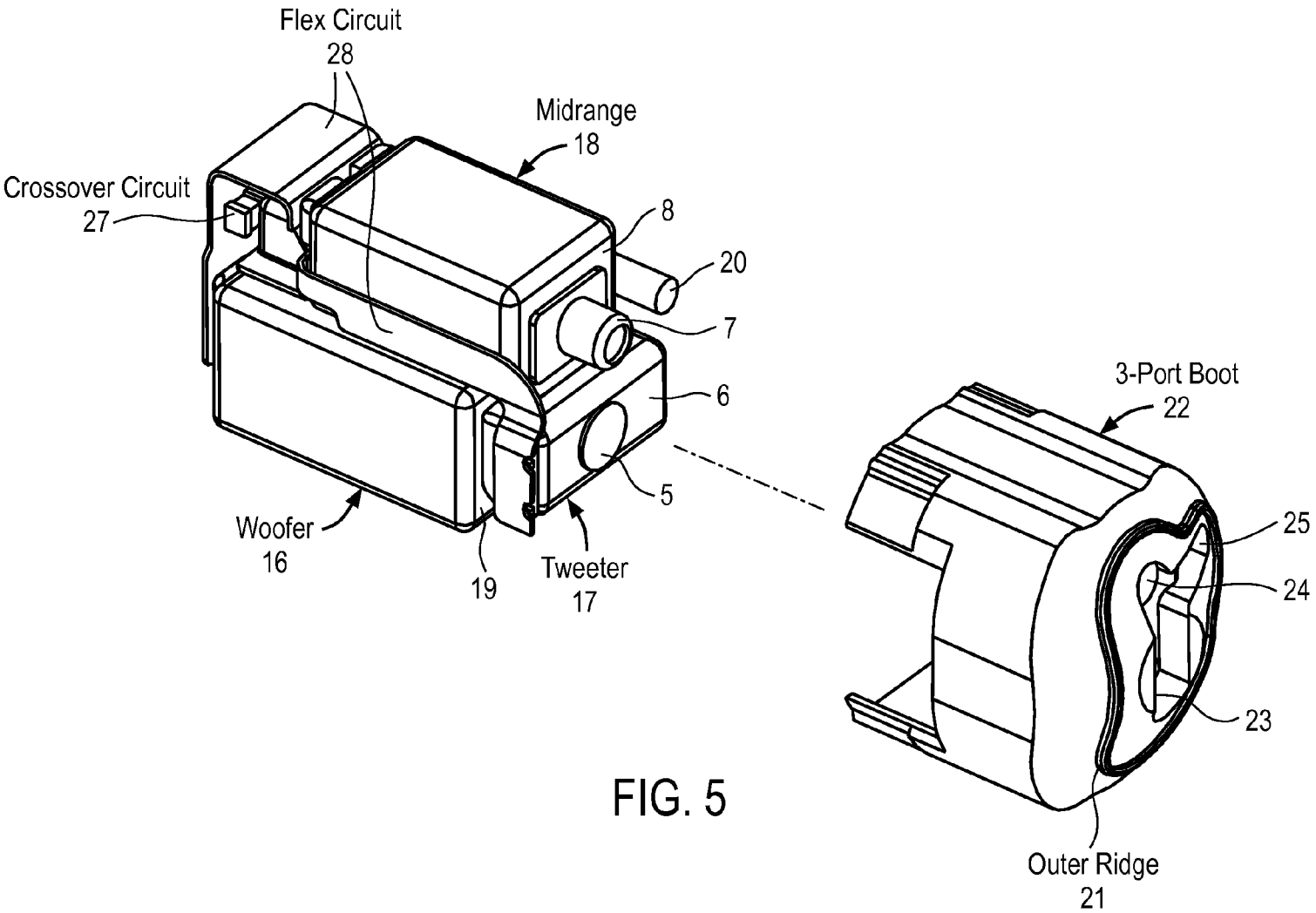
FIG. 5 is a perspective view of an assembly of three driver housings where each of the housings has its sound output port formed in an exterior wall of housing.

FIG. 5 is a perspective view of an assembly of three driver housings where each of the housings has a respective sound output port formed in its exterior wall. This embodiment is similar to the 3-way driver assembly depicted in FIG. 2B except that the housing of the woofer 16 has a sound output port 20 (being a tube in this case) that extends out from the right side exterior housing wall and upward. The exit of this bass output tube (sound output port 20) fits into a passage 25 that is formed in the sole of a 3-port boot 22. The latter has two additional passages 24, 23 that are aligned with the exits of the midrange and tweeter sound output ports 7, 5, respectively, as shown. The mixing space 36 (see FIG. 3A for the 2-port boot 10) in the case of the 3-port boot 22 opens to the exits ports of all three passages 23, 24, 25 so that the individual sounds are first mixed together outside of the boot 29 in the space between the front face of the booth 29 and the rear face of the cap 12. This arrangement is similar to the earbud that has the 2-port boot 10 depicted in FIG. 1A, where it is understood that as for the 2-port boot 22, the cap opening, from which the spout 15 extends forward, will be in communication with the mixing space 36 while remaining within the periphery of the outer ridge 21.

Figure 6:
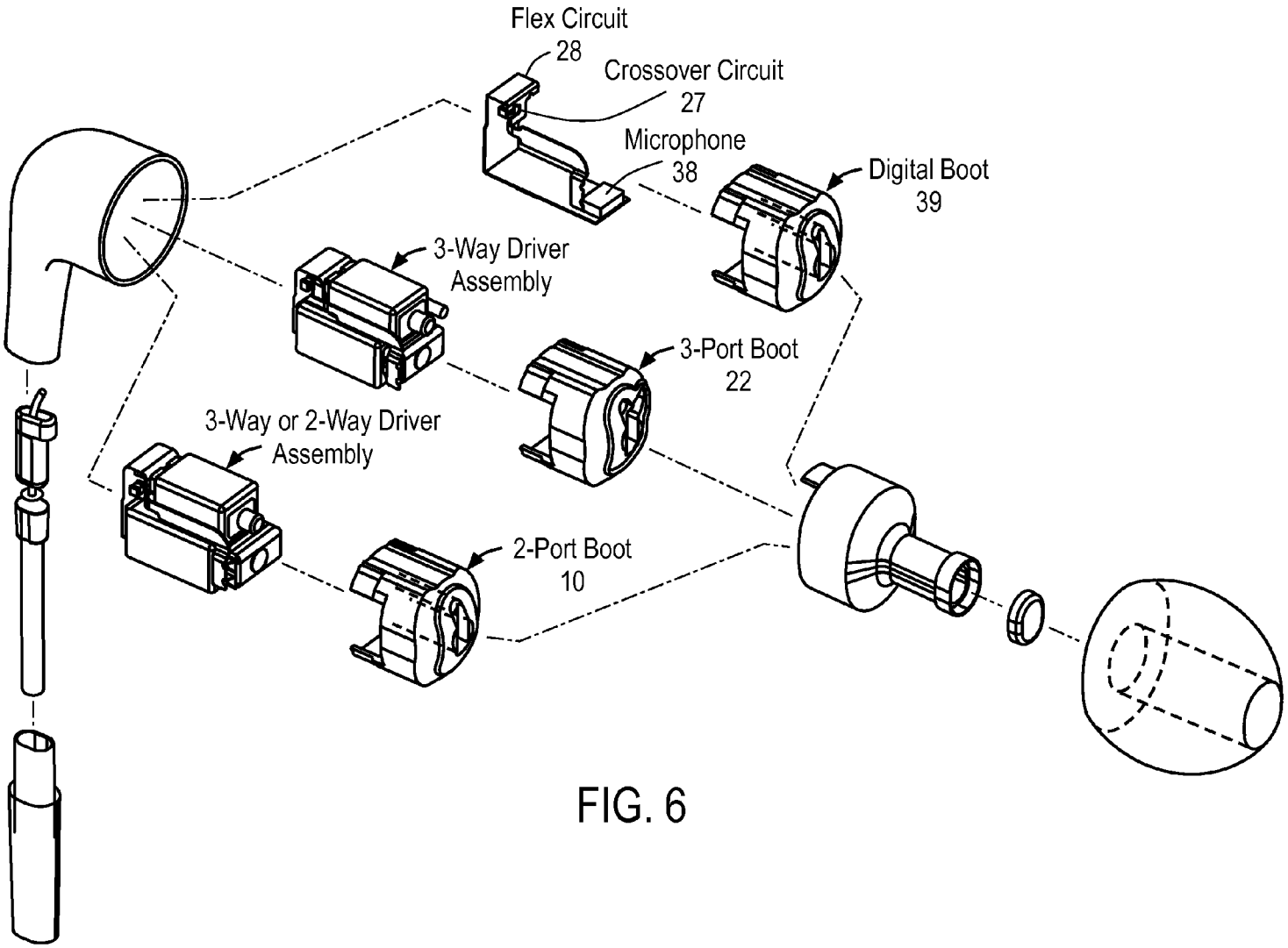
FIG. 6 is an exploded view of several different earbuds, including one with three driver housings and two sound output ports connecting with a two-port boot assembly, another with three driver housings and three sound output ports connecting with a three-port boot assembly, and a flex circuit assembly suitable for either a three-way or two-way earbud.

FIG. 6 is an exploded view of several of the different earbuds described above, all of which can share the same housing 1, cap 12, and sleeve 14, but use different combinations of the boot and the multi-way driver assembly. In one case, a 2-port boot 10 is used in combination with either a 2-way driver assembly (see FIG. 1) or a 3-way driver assembly (see FIG. 2B). In another embodiment, a 3-port boot 22 is used in combination with a 3-way driver assembly that has separate sound output ports for all three drivers extending out their respective housing walls and then communicating directly with their respective passages in the boot 22—see FIG. 5). In a further embodiment, a digital boot 39 is used that allows the acoustic microphone 38 to be installed on the flex circuit 28, where it should be clear that either a 2-way or a 3-way driver assembly can be used in such an embodiment.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the driver housings depicted in the figures are polyhedrons, the "sides" of a driver housing may alternatively be a single, continuously smooth wall that wraps around (like a ring), rather than discrete faces as in a polyhedron. Also, while FIGS. 1 and 2A show the earbud as being a sealing type in which a flexible sleeve or ear tip 14 is fitted to the cap 12, an alternative there is to omit the ear tip 14 and shape the cap 12 and the spout 14 to achieve a loose fitting, non-sealing earbud. The description is thus to be regarded as illustrative instead of limiting.

What is claimed is:

1. An earbud comprising:

an earbud cup;

a first driver housing having a rear side, a front side, a top face a bottom face, and a sound output tube extending from the front side; and a second driver housing having a top side, a bottom side, a front face, a rear face, and a sound output opening formed in the front face of the second housing with essentially no tube extending therefrom, and wherein the rear face of the second housing is disposed a) in front of the front side of the first housing, and b) behind an exit of the sound output tube of the first housing.

2. The earbud of claim 1 further comprising, inside the second housing, a balanced armature motor that is coupled to drive a diaphragm that is oriented substantially parallel to the front face of the second housing.

3. The earbud of claim 2 further comprising, inside the first housing, a diaphragm that is oriented substantially parallel to the top face of the first housing.

4. The earbud of claim 1 further comprising:

a crossover circuit having one of a low frequency output that is coupled to an electrical terminal in the first driver housing, and a high frequency output that is coupled to an electrical terminal in the second driver housing; and an electrical cable that is connected to a) an input of the crossover circuit at one end and b) an accessory connector at another end.

5. The earbud of claim 1 wherein each of the first and second housings is essentially a parallelepiped.

6. The earbud of claim 1 further comprising a boot having first and second passages formed therein, wherein the driver housings fit into the boot and the first and second passages are aligned with the sound output tube of the first housing and the sound output opening of the second housing, respectively.

7. An earbud comprising:

an earbud cup;

a low driver housing having a rear side, a front side, a top face and a bottom face;

a middle driver housing having a rear side, a front side, a top face and a bottom face, a sound output tube extending from the front side of the middle housing, wherein the bottom face of the middle housing is disposed adjacent to the top face of the low housing; and a high driver housing having a top side, a bottom side, a front face and a rear face, a sound output opening formed in the front face of the high housing, and wherein the rear face of the high housing is disposed a) adjacent to the front side of the low housing and b) behind an exit of the sound output tube of the middle housing.

8. The earbud of claim 7 wherein the top face of the low driver housing has a greater area than either the rear side or the front side of the low driver housing, as does the bottom face of the low driver housing.

9. The earbud of claim 7 further comprising a driver electrical terminal exposed on the rear side of the low housing and another driver electrical terminal exposed on the rear side of the mid housing.

10. The earbud of claim 9 further comprising:

a driver electrical terminal exposed on a left side or a right side of the high housing; and a flex circuit that routes a wire from the driver electrical terminal of the high housing rearward, by running along the top face of the low housing.

11. The earbud of claim 7 further comprising, inside the high driver housing, a balanced armature motor that is coupled to drive a diaphragm which is oriented substantially parallel to the front face of the high housing.

12. The earbud of claim 7 further comprising a sound output tube extending out and then upward from a left side or a right side of the low housing.

13. The earbud of claim 7 further comprising a boot having first and second passages formed therein, wherein the low, middle and high driver housings fit into the boot, and the first and second passages are aligned with the sound output tube of the middle housing and the sound output opening of the high housing, respectively.

14. The earbud of claim 13 further comprising a sound output tube extending out and then upward from a left side or a right side of the low housing, wherein the boot has a third passage formed therein that is aligned with an exit of the sound output tube that extends from the low housing.

15. The earbud of claim 13 further comprising a cap having an opening that is aligned with and is large enough to encompass the exits of the first and second passages in the boot.

16. The earbud of claim 15 further comprising an ear tip that fits onto the cap.

17. The earbud of claim 16 further comprising an acoustic microphone that fits into the boot, a further hole formed in the boot that enables sound from the space that is between the front face of the boot and the rear face of the cap to reach an acoustic entry of the microphone.

18. The earbud of claim 17 wherein the microphone is located a) below the bottom side of the high driver housing, and b) in front of the front side of the low driver housing.

19. The earbud of claim 17 further comprising an inertial sensor that is located in the earbud cub.

20. The earbud of claim 19 further comprising a flex circuit that electrically connects with the microphone, the inertial sensor and the low and middle driver housings, where the flex circuit runs rearward from the microphone along the bottom face of the low housing and then up to connect with the low driver housing and the middle driver housing.

21. The earbud of claim 15 further comprising a spout that extends forward from the cap where it is aligned with the cap opening, wherein the spout presents an uninterrupted space that communicates with the exit ports of the first and second passages at the cap opening, wherein the ear tip fits onto the spout, and wherein the spout has an equivalent radius to length ratio in the range 1/4 to 1/7 plus a constant.

22. An earbud comprising:

an earbud cup;

a middle frequency driver parallelepiped housing stacked on top a low frequency driver parallelepiped housing;

a high frequency driver parallelepiped housing whose rear face is adjacent to a front side of the low driver housing and whose sound output port is an opening in a front face of the high frequency driver housing essentially without any sound output tube; and a resilient boot that grasps the low, middle and high frequency driver housings inside the earbud cup.

23. The earbud of claim 22 further comprising inside the high frequency driver housing a balanced armature motor that is coupled to vibrate a diaphragm, wherein the diaphragm is positioned substantially parallel to the front face of the high frequency driver housing.

24. The earbud of claim 22 further comprising:

a crossover circuit; and a flex circuit that electrically connects with the crossover circuit, and wherein the flex circuit routes a wire from a driver input terminal in the high frequency housing rearward and along a top face of the low frequency housing next to a left or right side of the middle frequency housing.

* * * * *

UNITED STATES PATENT AND TRADEMARK OFFICE

CERTIFICATE OF CORRECTION

PATENT NO. : 9,055,366 B2
APPLICATION NO. : 13/746900
DATED : June 9, 2015
INVENTOR(S) : Yacine Azmi and Arun D. Chawan It is certified that error appears in the above-identified patent and that said Letters Patent is hereby corrected as shown below:

In the Claims,

Column 11, Claim 9, line 33, please delete “low housing” and insert --low driver housing--.

Column 11, Claim 9, line 35, please delete “mid housing” and insert --mid driver housing--.

Column 11, Claim 10, line 38, please delete “high housing” and insert --high driver housing--.

Column 11, Claim 10, line 40, please delete “high housing” and insert --high driver housing--.

Column 11, Claim 10, line 41, please delete “low housing” and insert --low driver housing--.

Column 11, Claim 11, line 45, please delete “high housing” and insert --high driver housing--.

Column 11, Claim 12, line 48, please delete “low housing” and insert --low driver housing--.

Column 11, Claim 13, line 53, please delete “middle housing” and insert --middle driver housing-- and delete “high housing” and insert --high driver housing--.

Column 11, Claim 14, line 57, please delete “low housing” and insert --low driver housing--.

Column 12, Claim 14, line 3, please delete “low housing” and insert --low driver housing--.

Column 12, Claim 16, line 8, please delete “cap” and insert --cup--.

Column 12, Claim 17, line 12, please delete “cap” and insert --cup--.

Column 12, Claim 19, line 18, please delete “cub” and insert --cup--.

Signed and Sealed this
Twenty-seventh Day of October, 2015

Michelle K. Lee

Michelle K. Lee
*Director of the United States Patent and Trademark Office*

Column 12, Claim 21, line 26 in both places and line 29, please delete “cap” and insert --cup--.

Column 12, Claim 22, line 35, please delete “top a” and insert --top of a--.

Column 12, Claim 22, line 37, please delete “low driver” and insert --low frequency driver--.

Column 12, Claim 24, at lines 52, 53 and 54, please delete “frequency housing” and insert --frequency driver housing--.